US011208817B2

(12) United States Patent
Locatell

(10) Patent No.: US 11,208,817 B2
(45) Date of Patent: Dec. 28, 2021

(54) REMOVABLE FORM TIE SYSTEM

(71) Applicant: Frank Locatell, Arcadia, CA (US)

(72) Inventor: Frank Locatell, Arcadia, CA (US)

( * ) Notice: Subject to any disclaimer, the term of this patent is extended or adjusted under 35 U.S.C. 154(b) by 548 days.

(21) Appl. No.: 16/357,298

(22) Filed: Mar. 18, 2019

(65) Prior Publication Data

US 2019/0211573 A1 Jul. 11, 2019

Related U.S. Application Data

(62) Division of application No. 15/454,547, filed on Mar. 9, 2017, now Pat. No. 10,323,423.

(51) Int. Cl.
*E04G 17/075* (2006.01)
*E04G 11/12* (2006.01)

(52) U.S. Cl.
CPC ..... *E04G 17/0752* (2013.01); *E04G 11/12* (2013.01)

(58) Field of Classification Search
CPC ..... E04G 17/14; E04G 17/0752; E04G 11/12
See application file for complete search history.

(56) References Cited

U.S. PATENT DOCUMENTS 1,663,104 A * 3/1928 Wales ..... E04G 17/0754 24/130
3,341,998 A * 9/1967 Joseph ..... E04B 1/4178 52/379

* cited by examiner

*Primary Examiner* — Robert A Vetere
(74) *Attorney, Agent, or Firm* — Todd R. Miller

(57) ABSTRACT

A removable form tie system and methods of construction using same are disclosed. The removable form tie system may comprise first and second brackets for respectively mounting to a first and second forms spaced apart from one another. A wire runs from the first bracket to the second bracket. Each bracket preferably comprises a fastening wall and a channel adapted to receive one end of the wire. Each bracket may further comprise a holder for receiving the wire at a substantially orthogonal angle after being received by the channel. The holder may comprise a portion of a stiffening wall extending substantially orthogonally away from the fastening wall, as well as a detent extending substantially orthogonally away from the first stiffening wall. In the alternative, the holder may be an extension from the fastening wall, wherein the holder extends substantially orthogonally away from the first fastening wall and then bends back to be generally parallel to the first fastening wall. Where the forms are plywood, a bracket may include a stiffening wall extending generally orthogonal away from the fastening wall, wherein the stiffening wall includes a sleeve adapted to receive a pin. Methods of using the form tie system include using the brackets with sleeve and pin arrangement to secure one or more braces, such as walers or strong backs, to maintain rigidity of the forms. The disclosed inventions advantageously permit wet concrete to be poured between the forms and troweled with ease. The wire may be easily removed from the concrete, even days after the concrete has cured, for an aesthetically pleasing result without concern of wire oxidization issues.

12 Claims, 7 Drawing Sheets

REMOVABLE FORM TIE SYSTEM

CROSS-REFERENCE TO RELATED APPLICATION

The present application claims benefit of and priority to U.S. patent application Ser. No. 15/454,547 filed on Mar. 9, 2017 and incorporated by reference as if fully set forth herein.

BACKGROUND

The present disclosure relates generally to construction and particularly to form ties used in the forming and pouring of concrete walls.

SUMMARY

One exemplary embodiment of the disclosed subject matter is a removable form tie system comprising a first bracket for mounting to a first form and a second bracket for mounting to a second form. The second form is spaced apart from the first form. The system further comprises a wire having a first end and a second end, wherein the wire runs from the first bracket to the second bracket.

The first bracket preferably comprises a first fastening wall and a first channel adapted to receive the first end of the wire. The first bracket further comprises a first holder for receiving the wire at a substantially orthogonal angle after being received by the first channel. The second bracket preferably comprises a second fastening wall and a second channel adapted to receive the second end of the wire. The second bracket further comprises a second holder for receiving the wire at a substantially orthogonal angle after being received by the second channel.

The first bracket may further comprise a first stiffening wall extending substantially orthogonally away from the first fastening wall. The first holder may comprise a portion of the first stiffening wall and a first detent extending substantially orthogonally away from the first stiffening wall. The first stiffening wall may include a cutout for receiving the wire after being received by the first holder. The cutout receives the wire at a substantially orthogonal angle to the wire disposed in the first holder.

In the alternative to the stiffening wall and detent arrangement, the first holder may extend substantially orthogonally away from the first fastening wall and then bend back to be generally parallel to the first fastening wall.

In yet another embodiment, the second bracket further comprises a second stiffening wall extending substantially orthogonally away from the second fastening wall. The second stiffening wall includes a sleeve disposed about the second stiffening wall, wherein the sleeve is adapted to receive a pin for securing one or more braces to a form.

The second holder may comprise a portion of the second stiffening wall and a second detent extending substantially orthogonally away from the second stiffening wall. The second fastening wall may include a support for supporting the wire.

Another exemplary embodiment of the disclosed subject matter is a method of construction comprising placing a first form apart from a second form and laying a wire having a first end and an opposing second end across the first and second forms. The method further comprises mounting a first bracket onto the first form, wherein the first bracket has a first channel adapted to receive the first end of the wire, and wherein the first bracket has a first fastening wall and a first holder. A second bracket may be mounted onto the second form, wherein the second bracket has a second channel adapted to receive the second end of the wire, and wherein the second bracket has a second fastening wall and a second holder. The first end of the wire may be bent substantially orthogonal to itself to fit within the first holder. The second end of the wire may also be bent substantially orthogonal to itself to fit within the second holder.

The first and second forms may be plywood. If plywood, the second bracket preferably includes a stiffening wall extending generally orthogonal away from the second fastening wall, wherein the stiffening wall includes a sleeve adapted to receive a pin.

The method may then further comprise placing a first waler against the first form, securing the pin against the first waler, and mounting the pin to the first waler. Similarly, the method may further comprise placing a first waler against the first form, placing a first strong back against the first waler, securing the pin against the first strong back, and mounting the pin.

The method may also comprise pouring wet concrete between the first and second forms and around the wire, allowing the concrete to cure, and removing the wire by pulling the wire away from the concrete. As the diameter of the wire is preferably smaller than the diameter of air pockets formed in the concrete wall after curing, a pleasing aesthetic look is effected.

A further exemplary embodiment of the disclosed subject matter is a method of construction comprising placing a first form apart from a second form and providing a first bracket having a first channel adapted to receive a first end of a wire. The first bracket has a first fastening wall and a first holder. The second bracket has a second channel adapted to receive a second end of the wire. The second bracket also has a second fastening wall and a second holder. The first end of the wire is inserted into the first channel. The second end of the wire is inserted into the second channel. The first bracket is then mounted to the first form. The second bracket is then mounted to the second form. The first end of the wire is bent substantially orthogonal to itself to fit within the first holder. The second end of the wire is bent substantially orthogonal to itself to fit within the second holder.

BRIEF DESCRIPTION OF THE DRAWINGS

Some non-limiting exemplary embodiments of the disclosed subject matter are illustrated in the following drawings. Identical or duplicate or equivalent or similar structures, elements, or parts that appear in one or more drawings are generally labeled with the same reference numeral, optionally with an additional letter or letters to distinguish between similar objects or variants of objects, and may not be repeatedly labeled and/or described. Dimensions of components and features shown in the figures are chosen for convenience or clarity of presentation. For convenience or clarity, some elements or structures are not shown or shown only partially and/or with different perspective or from different point of views.

DETAILED DESCRIPTION

Figure 1:
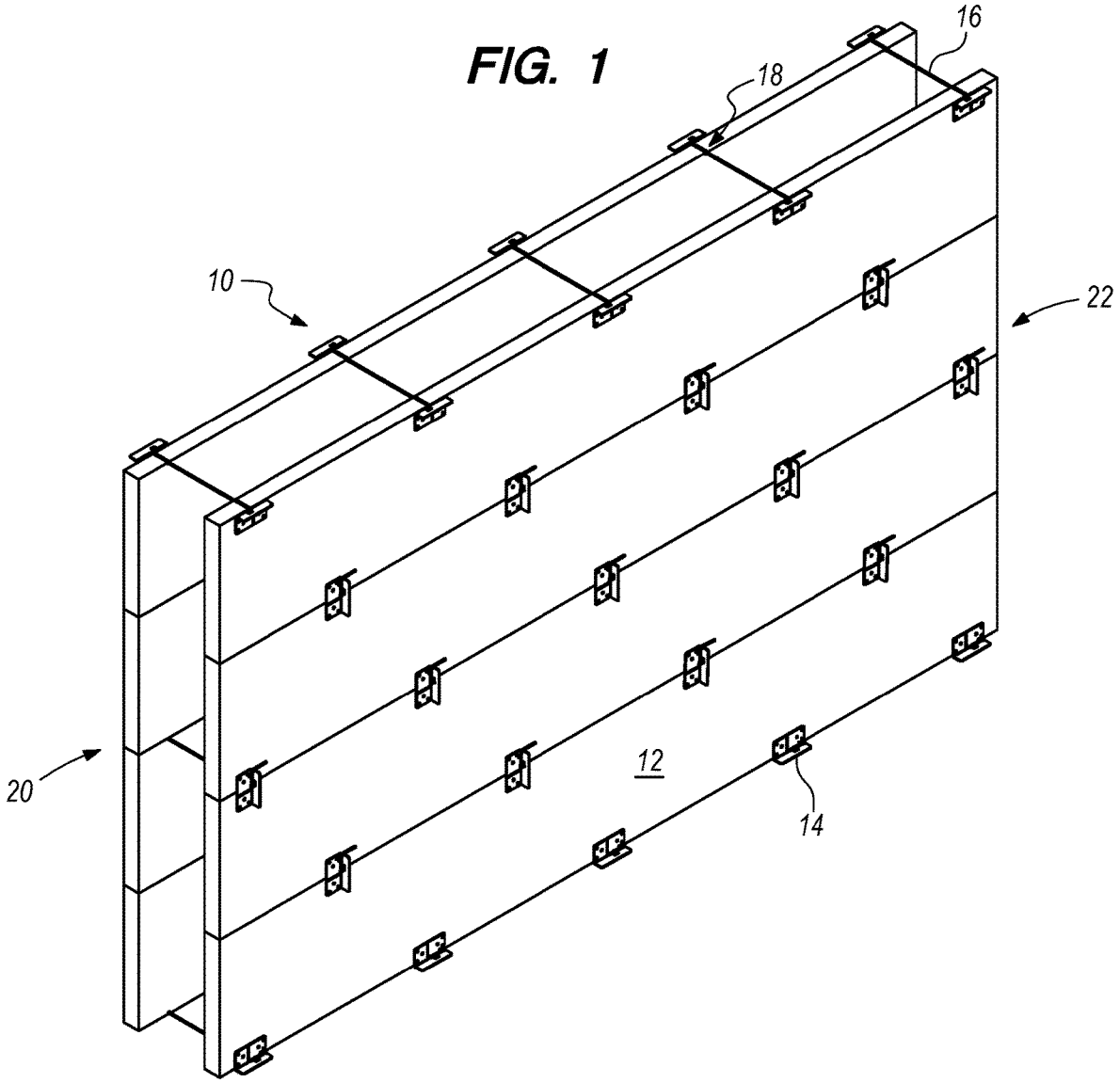
FIG. 1 is a perspective view of an embodiment of the removable form tie system disclosed herein.

The construction of a wall, barrier, or the like may be achieved through myriad techniques and materials. For example, brick and mortar may be used to create a wall without any need for framing or additional support. In contrast, forms, such as wooden boards, are used when pouring wet concrete or similar to hold the material in place until after it sets or cures. Once cured, the forms are removed to reveal a solid concrete wall. The use of forms in this technique is analogous to the use of a mold to hold cake batter in place while the batter is being cooked in an oven. Once cooked, the mold is removed to reveal the solid cake in the shape of the cake mold.

Unlike cake batter, wet concrete is heavy and thus the loads involved are significantly higher. Thus forms alone are typically not used when pouring a concrete wall as there is a high likelihood the forms will be pushed outward due to the load of the wet concrete as it fills up between the forms. To keep the forms in place, form ties may be used to counter the outward load of the wet concrete.

Conventional form ties may comprise a rod or the like and mounting hardware at each end of the rod. The mounting hardware is typically fixed to opposing form walls. The wet concrete is poured between the form walls and around each rod and allowed to cure. The mounting hardware is then removed, but the rod itself is not. The tip of the rod sticking out of the concrete is usually broken or snapped off. Additional wet concrete may be troweled over the rod end to keep it hidden from view. Such an extra step adds cost to an already expensive system. Indeed, this arrangement is typically so costly that renting of the hardware is customary. In addition, as the rod used in such construction is usually some form of oxidizable metal, the rod may rust over time causing multiple problems including catastrophic failure of the wall itself.

To avoid such problems, efforts have been made to make a form tie having a rod with a tip that may be cut off at one end and then punched through the concrete wall once set. As this rod is larger in diameter than the miniscule air pockets, commonly referred to as bee holes, found in poured concrete walls, one is again left with having to trowel over or otherwise cover up the rather large holes left in the wall. Filling in such holes is often difficult; moreover, the filled-in holes often look different than the surrounding wall.

Where the form boards are comprised of plywood or other flexible material, additional bracing and hardware may be used in addition to conventional form ties. Such bracing, commonly referred to as walers and strong backs, may be placed either vertically or horizontally as needed on one or both sides of the form walls. One common problem with such an arrangement, or even where walers and strong backs are not also employed, is the need to keep the forms from moving inward before the concrete is poured between the walls. In an effort to solve this problem, an additional brace may be mounted between the form walls at the top. Such a brace does not easily allow the wet concrete to be troweled at the top as one must work around the brace.

Accordingly, a removable form tie system solving these and other problems is desired.

A general non-limiting overview of practicing the present disclosure is presented below. The overview outlines exemplary practice of embodiments of the present disclosure, providing a constructive basis for variant and/or alternative and/or divergent embodiments, some of which are subsequently described.

Figure 2:
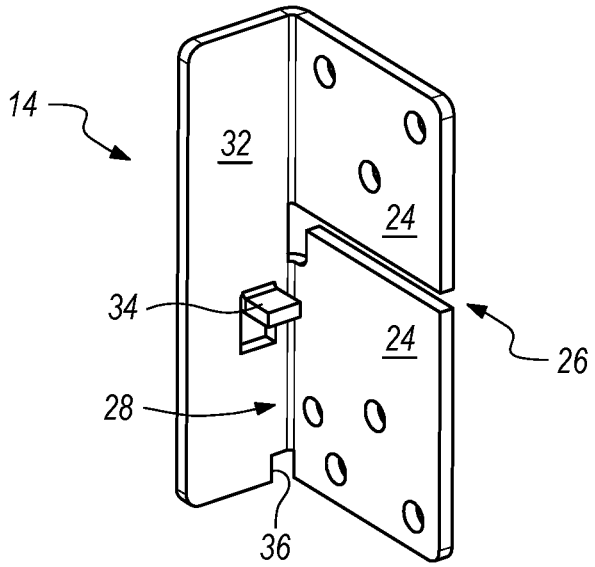
FIG. 2 is a perspective view of one of the brackets shown in FIG. 1.
Figure 3:
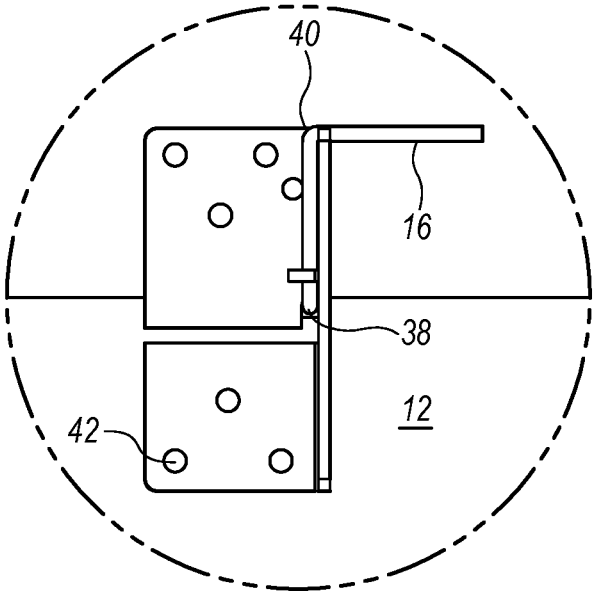
FIG. 3 is a detailed view of one of the brackets in use as seen in FIG. 1.

FIGS. 1-3 illustrate an embodiment of the removable form tie system 10 comprising a first bracket 14 mounted to a form 12 and second bracket 14 disposed opposite the first bracket 14 mounted to another form 12. A wire 16 is disposed between the brackets 14.

The brackets 14 and wire 16 are preferably made of steel and are reusable items. The steel wire 16 is preferably one-eighth inch in diameter.

To arrive at the arrangement seen in FIG. 1, simply lay the wire 16 across two parallel form boards 12 with our without the brackets 14 pre-assembled to the wire 12. With one bracket 14 attached over the wire 16, screw or nail the bracket 14 into the form lumber 12 on one side of the wall 20 and repeat the process on the other side 22 to secure the forms 12 in place. As strength is required at the top and bottom of each wall 20, 22, the brackets 14 and wires 16 may also be placed at both the top and the bottom of each wall 20, 22. As seen in FIG. 1, the longitudinal axis of the brackets 14 at the top or bottom of the walls 20, 22 should be placed parallel to the longitudinal axis of the forms 12 so each bracket 14 lies flush to the edge of each form 12. The remaining brackets 14 should have their longitudinal axis placed generally orthogonal to the longitudinal axis of the forms 12.

For seamless forming, a notch 18 may be formed in each form 12 to allow the wire 16 to be recessed as the form boards 12 are stacked. Once stacked to the desired height, wet concrete (not shown) may be placed between the walls. The brackets 14 installed at the top of each wall 20, 22 may be swiveled up allowing the concrete to be troweled and edged without removing the bracket 14 and wire 16, thus retaining the integrity of the strength of the forms 12. Once cured, the wires 16 may be removed, without any special tools, from walls 20, 22 even days after the concrete is installed allowing for maximum curing rates. As a result, little to no flaking or adhesion to the form boards 12 takes places leaving a crisp finish to the concrete wall.

Turning in detail to FIGS. 2-3, the bracket 14 comprises a fastening wall 24 with a channel 26 through which the wire 16 is passed. The fastening wall 24 also has mounting holes 42 through which a nail, screw, or the like is passed to mount the bracket 14 onto the form 12. The bracket 14 also has a holder 28 for holding the wire 16 after it is passed through the channel 26. As seen best in FIG. 2, the holder 28 comprises a portion of stiffening wall 32 and detent 34. The stiffening wall 32 preferably extends generally orthogonal to the fastening wall 24. The detent 34 preferably extends generally orthogonal to the stiffening wall 32 and/or generally parallel to the fastening wall 32. Stiffening wall 32 preferably has an optional cutout 36 for further securing the wire 16 against the bracket 14.

As seen in FIGS. 1 and 3, the wire 16 preferably has a first bend 38 generally orthogonal to the longitudinal axis of the wire 16 as it runs across the walls 20, 22. The wire 16 has a second bend 40 generally orthogonal to the direction of the first bend 38 at or about the cutout 36. Such bends 38, 40 in the wire 16 allow the wire 16 to fit securely against the bracket 14 and otherwise preclude the wire 16 from being pulled outward and away from the bracket 14 when loaded with the wet concrete.

As the wire 16 needs to be inserted through both the front and rear panels of the forms 12, only one end of the wire 16 may be pre-bent. In such case, the other end of the wire 16 will need the second bend 40 to be done after the wire 16 has been inserted through both pieces of forms 12. As the brackets 14 that sit at the top and bottom of the forms 12 are designed to sit flush atop and underneath the walls so as not to interfere with the concrete foundation or any troweling atop the wall, the wire bends 38, 40 have a different configuration such the second bend 40 will be parallel to the edge of the form 12.

Figure 4:
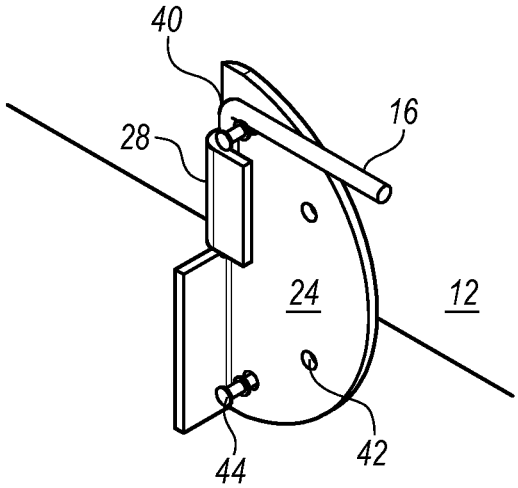
FIG. 4 is a perspective view of a second embodiment of a bracket for use with the disclosed form tie system.

FIG. 4 is a perspective view of a second embodiment of a bracket 14 for use with the disclosed form tie system 10. As seen in FIG. 4, this bracket 14 comprises a fastening wall 24 with mounting holes 42 through which mounting hardware 44 (such as a nail, screw, or the like) is placed. The shape of the fastening wall 24 in FIG. 4 is hemispherical. However, the shape need not be hemispherical; it may be rectangular, as seen in the other embodiments, or of varying shape. The bracket 14 also comprises a holder 26 for holding the wire 16 after it is passed through a channel (not seen in FIG. 4). The holder 26 is preferably arcuate with the holder 26 initially extending generally orthogonal to the fastening wall 24 and then bending back to be generally parallel to fastening wall 24. The wire 16 preferably has a first bend (not seen in FIG. 4) generally orthogonal to the longitudinal axis of the wire 16 as it runs across the walls 20, 22. The wire 16 has a second bend 40 generally orthogonal to the direction of the first bend. The bends in the wire 16 serve the same function as disclosed above in conjunction with FIGS. 1 and 3.

The forms 12 used in the removable form tie system 10 may be comprised of virtually any material including plywood. FIGS. 5-11 illustrate a removable form tie system 10 as seen in FIG. 1 with a third embodiment of a bracket 14 having a sleeve 48 for holding a pin 50 for use with an optional waler 52 and optional strong back 54. The use of walers 52 and strong backs 54 may be needed for forming applications using thinner form material such as plywood, which is not considered sufficiently rigid by itself.

Figure 6:
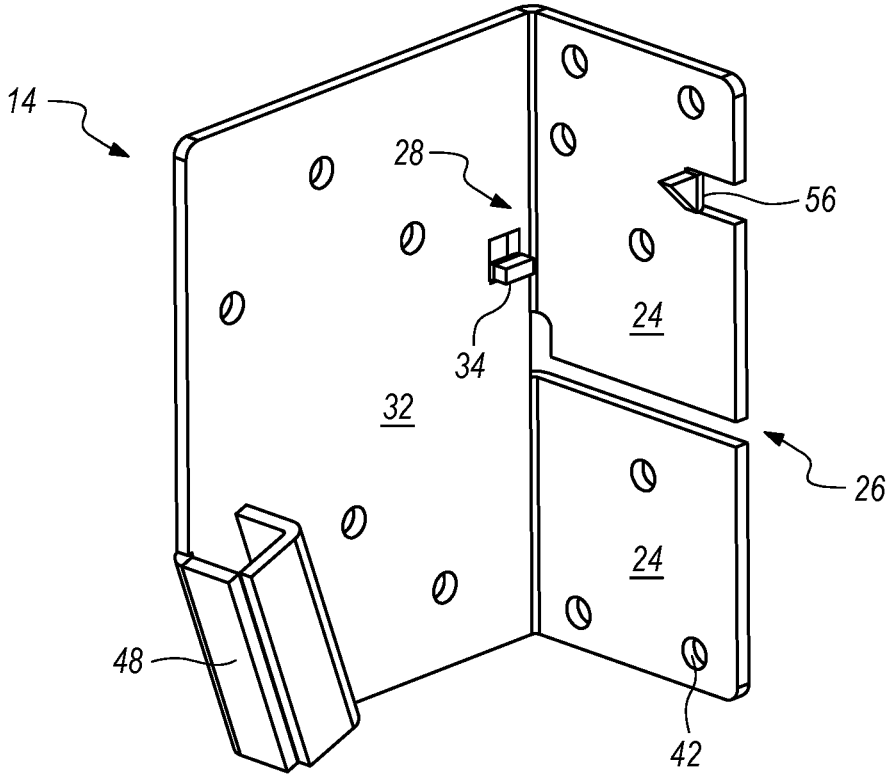
FIG. 6 is a perspective view of the third embodiment of the bracket having a sleeve.
Figure 7:
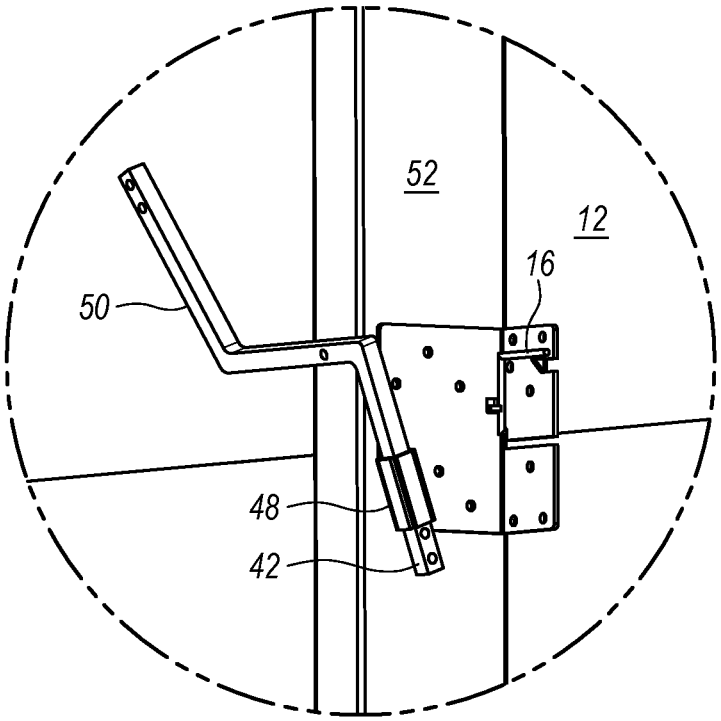
FIG. 7 is a detailed view of the bracket with sleeve and pin in use as seen in FIG. 5.

Turning in detail to FIGS. 6-7, the bracket 14 comprises a fastening wall 24 with a channel 26 through which the wire 16 is passed. The fastening wall 24 also has mounting holes 42 through which a nail, screw, or the like is passed to mount the bracket 14 onto the form 12. The bracket 14 also has a holder 28 for holding the wire 16 after it is passed through the channel 26. The holder 28 comprises a portion of stiffening wall 32 and detent 34. The stiffening wall 32 preferably extends generally orthogonal to the fastening wall 24. The detent 34 preferably extends generally orthogonal to the stiffening wall 32 and/or generally parallel to the fastening wall 32. Fastening wall 24 preferably has an optional support 56 for further securing the wire 16 against the bracket 14. As best seen in FIG. 7, the wire 16 preferably has first and second bends as disclosed above to allow the wire 16 to fit securely against the bracket 14 and otherwise preclude the wire 16 from being pulled out and away from the bracket 14 as the load of the concrete pour increases.

Figure 5:
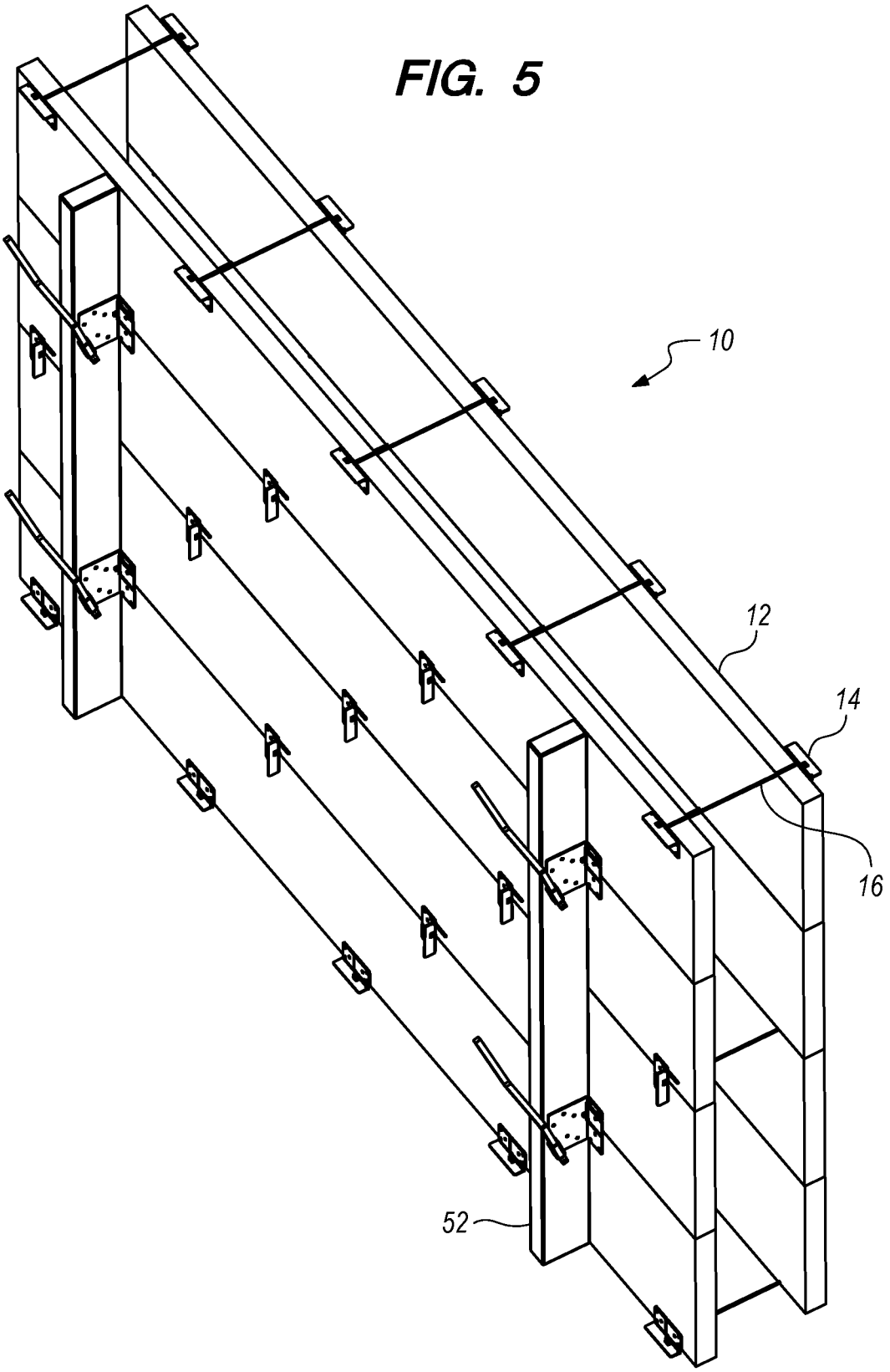
FIG. 5 is a perspective view of the removable form tie system as seen in FIG. 1 with a third embodiment of a bracket having a sleeve for holding a pin for use with a waler.

To arrive at the arrangement seen in FIG. 5, the large bracket 14 with sleeve 48 is installed on the form board 12 using the same procedure as with the small bracket 14 disclosed above. Next, the waler 52 should be seated against both the form board 12 and the large bracket 14. Screws, nails, or other such mounting hardware secure the waler 52 to the bracket 14 held in place by the pin 50 set into the sleeve 48 and seated against the waler 2. Once set in place, as best seen in FIG. 7, screws or the like are passed through mounting holes 42 in the pin 50 to secure the pin 50 in place to eliminate the possibility of movement.

Figure 8:
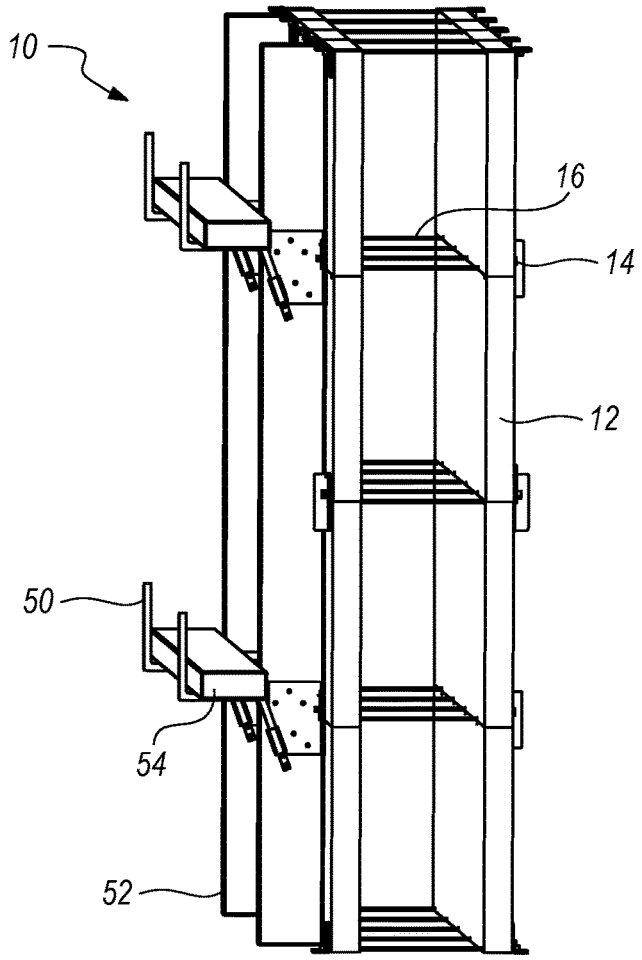
FIG. 8 is a perspective view of the removable form tie system as seen in FIG. 5 with a strong back added adjacent to the waler.
Figure 9:
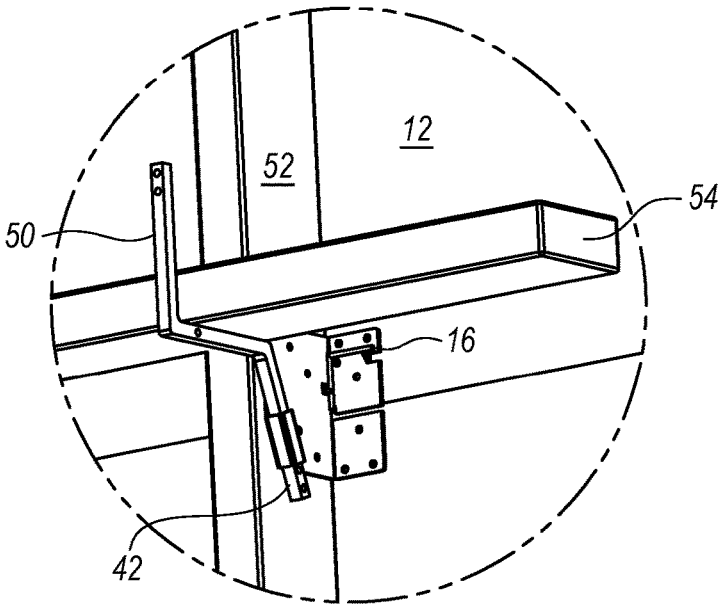
FIG. 9 is a detailed view of the bracket with sleeve and pin in use with a waler and strong back as seen in FIG. 8.

For additional rigidity, a strong back 54 may be used as seen, for example, in FIG. 8. If a strong back 54 is used, the pin 50 may be set to seat the strong back 54 against the waler 52. Once set, the pin 50 may be secured with mounting hardware through the mounting holes 42 provided in the pin 50, as best seen in FIG. 9. After securing the bracket 14 and pin 50 in place, the form boards 12 are held firmly in place and are ready for placement of wet concrete.

Figure 10:
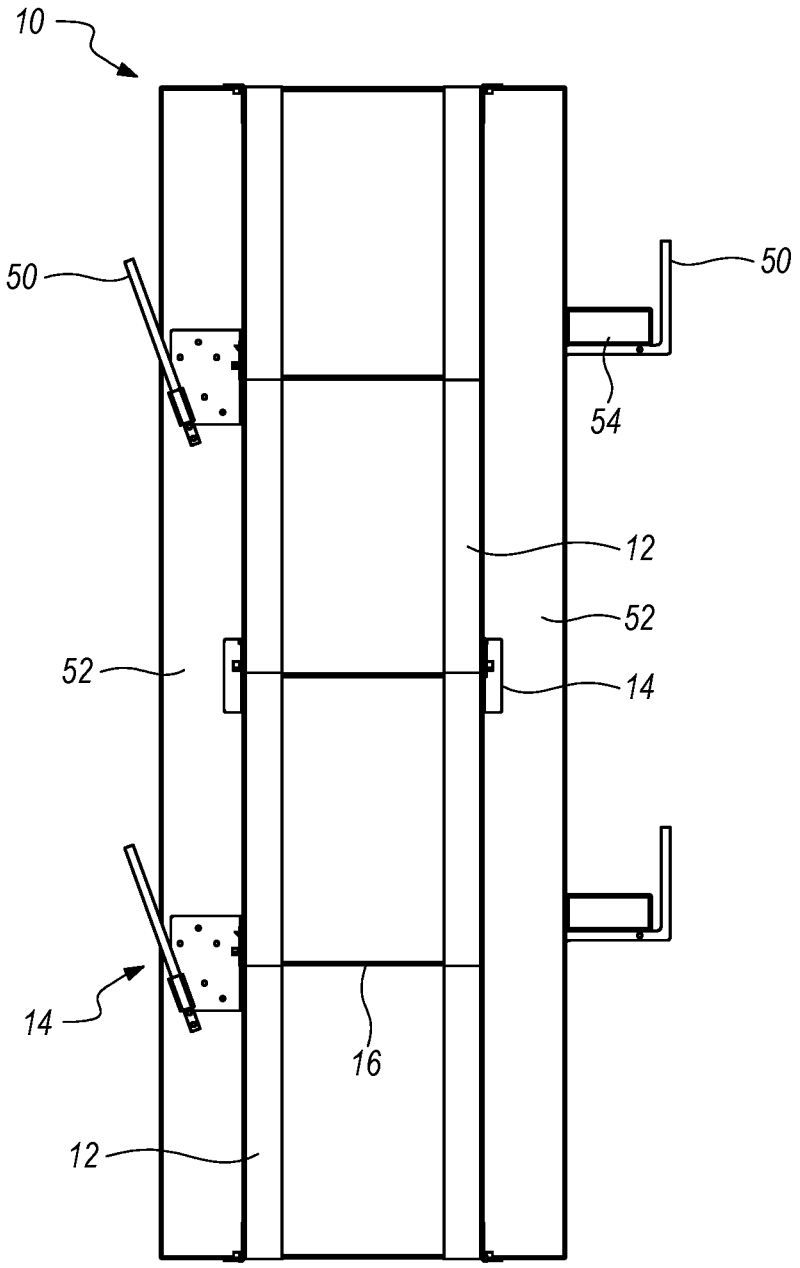
FIG. 10 is a side view of the removable form tie system as seen in FIG. 8 with a second waler added opposite the first waler, the second waler also held in place against the form boards using the bracket with sleeve and pin arrangement.
Figure 11:
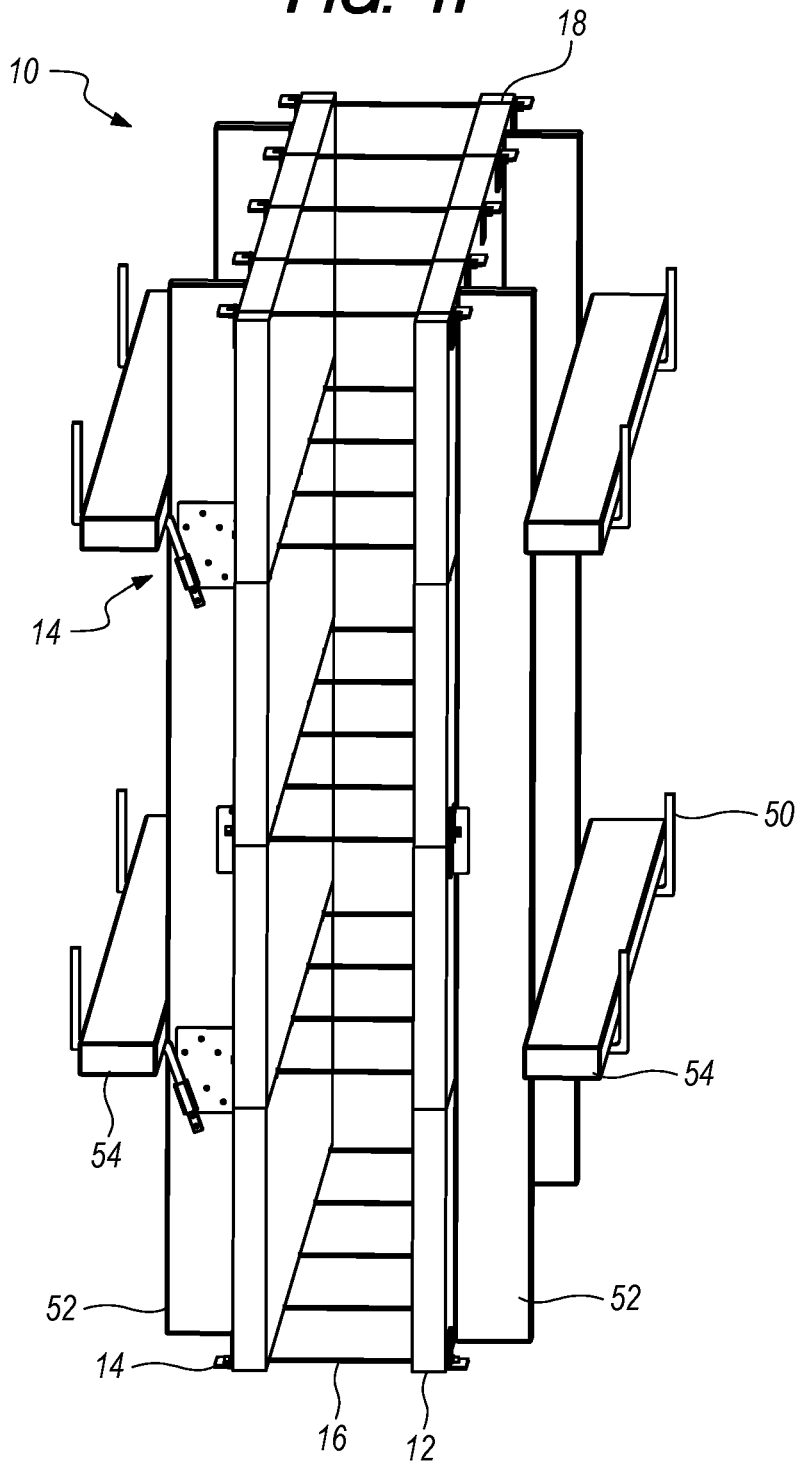
FIG. 11 is a perspective view of the removable form tie system as seen in FIG. 10 with a second strong back added opposite the first strong back, the second waler and second strong back held in place against the forms using the bracket with sleeve and pin arrangement.

Should additional rigidity be desired, additional walers 52 and/or strong backs 54 may be used as desired. FIG. 10 is a side view of the removable form tie system 10 as seen in FIG. 8 with a second waler 52 added opposite the first waler 52, the second waler 52 also held in place against the form boards 12 using the bracket 14 with sleeve 48 and pin 50 arrangement. FIG. 11 is a perspective view of the removable form tie system 10 as seen in FIG. 10 with a second strong back 54 added opposite the first strong back 54, the second waler 52 and second strong back 54 held in place against the forms 12 using the bracket 14 with sleeve 48 and pin 50 arrangement.

It should now be apparent that the disclosed form tie system 10 is incredibly versatile. The invention may be used in any number of applications from residential to highway construction. Straight or curved walls of any width may be formed efficiently, inexpensively, and attractively using any type of form material including flexible plywood or thin bender board used in landscape curb walls.

The disclosed removable form tie system 10 also advantageously allows for outboard rigidity as well as inward support. The invention does so without the need for any internal form tie hardware, such as nuts, bolts, or fasteners, that typically get gummed up or broken during construction.

Moreover, as the wire 16 is preferably one-eighth inch in diameter, when the wire 16 is removed, the holes left in the surface of the concrete are so tiny they completely blend in with the miniscule air pockets or bee holes found in poured concrete walls. As a result, the finished product has no evidence of the use of form ties.

Two examples of primary applications for the disclosed invention are (1) board form finish concrete walls, and (2) strip and finish walls. Board form finish concrete walls are a much sought-after look. In this application, the boards used in the forming of the wall are carefully selected and often rough cut or sandblasted to accentuate the grain of the lumber. With the disclosed invention, the wires 16 may be left in the form for days before stripping the forms away. The result is a finished product with finer detail and highly desired aesthetics. Strip and finish walls refers to a wall in which the forms must be taken off while the concrete is still plastic or soft enough to allow troweling to the desired finish. In this application, the user of the disclosed invention will merely remove the wire 16 from the bracket 14 and pull the wire 16 out of the wall by hand. No patching is required.

While certain embodiments have been described, the embodiments have been presented by way of example only and are not intended to limit the scope of the inventions. Indeed, the novel form tie system disclosed herein may be embodied in a variety of other forms. Furthermore, various omissions, substitutions, and changes in the form of the disclosed elements may be made without departing from the spirit of the inventions. The accompanying claims and their equivalents are intended to cover such forms or modifications as would fall within the scope and spirit of the inventions.

The invention claimed is:

1. A method of construction, the method comprising:

placing a first form apart from a second form;

laying a wire having a first end and an opposing second end across the first and second forms;

mounting a first bracket onto the first form, wherein the first bracket has a first channel adapted to receive the first end of the wire, and wherein the first bracket has a first fastening wall and a first holder, wherein the first bracket further comprises a first stiffening wall extending substantially orthogonally away from the first fastening wall, wherein the first holder comprises a portion of the first stiffening wall and a first detent extending substantially orthogonally away from the first stiffening wall;

mounting a second bracket onto the second form, wherein the second bracket has a second channel adapted to receive the second end of the wire, and wherein the second bracket has a second fastening wall and a second holder;

bending the first end of the wire substantially orthogonal to itself to fit within the first holder; and bending the second end of the wire substantially orthogonal to itself to fit within the second holder.

2. The method of claim 1, wherein the first and second forms are plywood.

3. The method of claim 2, wherein the second bracket includes a stiffening wall extending generally orthogonal away from the second fastening wall, wherein the stiffening wall includes a sleeve adapted to receive a pin.

4. The method of claim 3, further comprising placing a first waler against the first form and securing the pin against the first waler.

5. The method of claim 3, further comprising placing a first waler against the first form, placing a first strong back against the first waler, and securing the pin against the first strong back.

6. The method of claim 1, further comprising pouring wet concrete between the first and second forms and around the wire, allowing the concrete to cure, and removing the wire by pulling the wire away from the concrete.

7. The method of claim 6, wherein the diameter of the wire is smaller than the diameter of air pockets formed in the concrete wall after curing.

8. A method of construction, the method comprising:

placing a first form apart from a second form;

providing a first bracket having a first channel adapted to receive a first end of a wire, and wherein the first bracket has a first fastening wall and a first holder, wherein the first holder extends substantially orthogonally away from the first fastening wall and then bends back to be generally parallel to the first fastening wall;

providing a second bracket having a second channel adapted to receive a second end of the wire, and wherein the second bracket has a second fastening wall and a second holder;

inserting the first end of the wire into the first channel;

inserting the second end of the wire into the second channel;

mounting the first bracket to the first form;

mounting the second bracket to the second form;

bending the first end of the wire substantially orthogonal to itself to fit within the first holder; and bending the second end of the wire substantially orthogonal to itself to fit within the second holder.

9. The method of claim 8, wherein the second bracket includes a stiffening wall extending generally orthogonal away from the second fastening wall, wherein the stiffening wall includes a sleeve adapted to receive a pin.

10. The method of claim 9, further comprising placing a first waler against the first form and securing the pin against the first waler.

11. The method of claim 9, further comprising placing a first waler against the first form, placing a first strong back against the first waler, and securing the pin against the first strong back.

12. The method of claim 8, further comprising pouring wet concrete between the first and second forms and around the wire, allowing the concrete to cure, and removing the wire by pulling the wire away from the concrete.

* * * * *